US005328030A

United States Patent [19]

Sutherland

[11] Patent Number: 5,328,030

[45] Date of Patent: Jul. 12, 1994

[54] SLEEVE-TYPE CARRIER

[75] Inventor: Robert L. Sutherland, Kennesaw, Ga.

[73] Assignee: Riverwood International Corporation, Atlanta, Ga.

[21] Appl. No.: 45,453

[22] Filed: Apr. 8, 1993

[51] Int. Cl.[5] ..... B65D 71/36

[52] U.S. Cl. ..... 206/429; 206/427; 206/434; 229/40

[58] Field of Search ..... 206/139, 140, 427, 429, 206/434; 229/40, 186-188

[56] References Cited

U.S. PATENT DOCUMENTS

| | | | |
|---|---|---|---|
| 3,294,280 | 12/1966 | Graser | 220/112 |
| 3,398,856 | 8/1968 | Graser | 220/115 |
| 3,705,681 | 12/1972 | Rossi et al. | 229/40 |
| 4,022,372 | 5/1977 | Graser | 229/40 |
| 4,440,340 | 4/1984 | Bakx | 206/434 |
| 4,482,090 | 11/1984 | Millens | 206/427 |
| 4,577,799 | 3/1986 | Oliff | 229/40 |
| 4,747,487 | 5/1988 | Wood | 206/429 |
| 4,919,266 | 4/1990 | McIntosh | 206/434 |
| 5,060,792 | 10/1991 | Oliff | 206/434 |

*Primary Examiner*—Jimmy G. Foster

[57] ABSTRACT

A carrier having an end panel construction that snaps into place during formation of the carrier and has the ability to follow the contour of adjacent curved or beveled packaged articles. Tabs foldably connected to an end panel flap and adjacent dust flaps cause the flaps to snap into place. The dust flaps are either connected to the side panels by angled fold lines or comprise continuations or extensions of the side panels.

15 Claims, 4 Drawing Sheets

FIG. 1
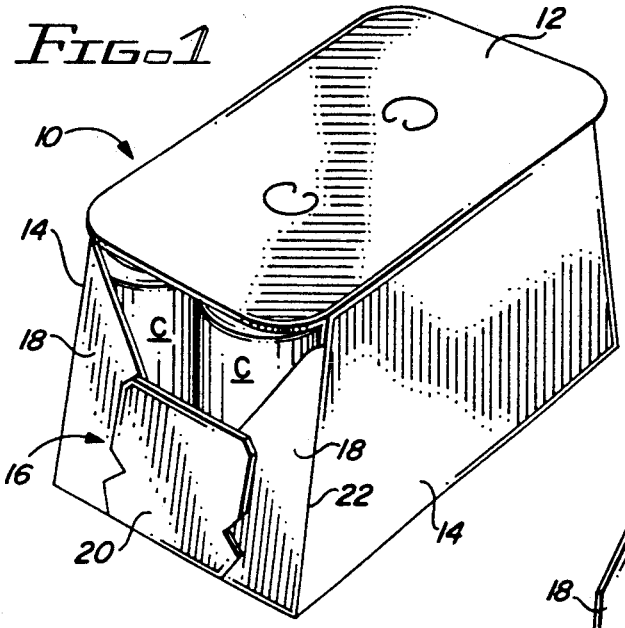
FIG. 3
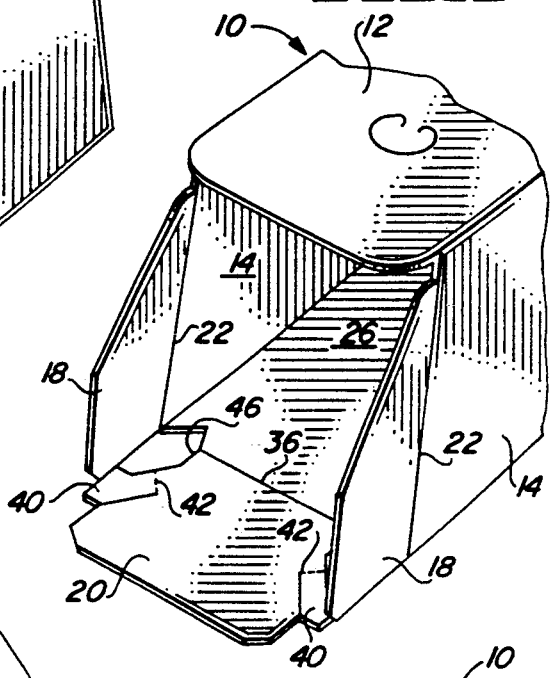
FIG. 4
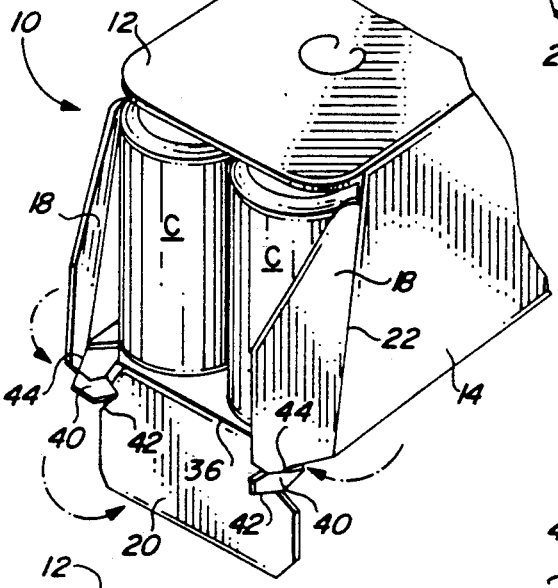
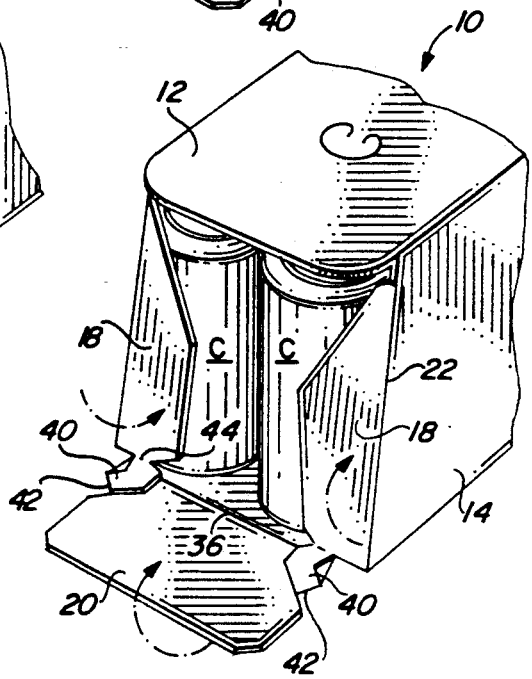
FIG. 5
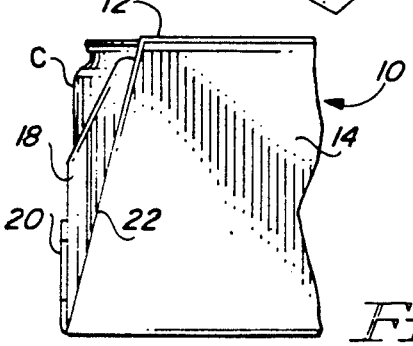
FIG. 6

FIG. 7
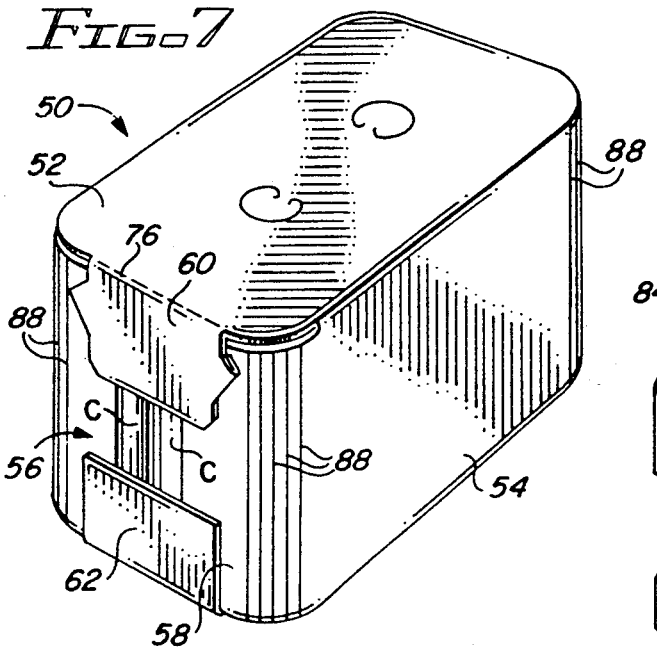
FIG. 9
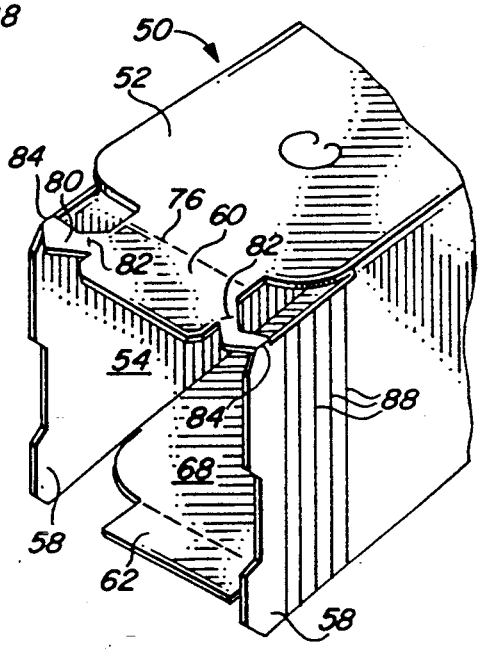
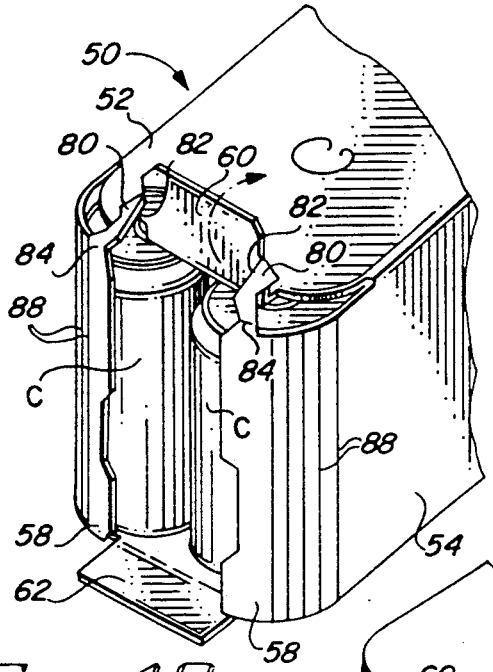
FIG. 10
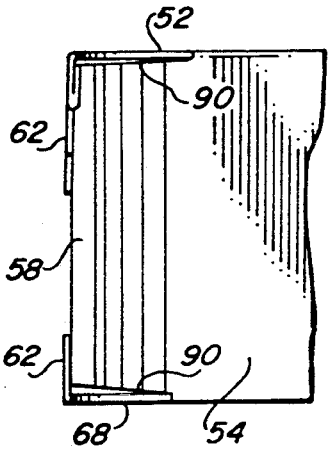
FIG. 12
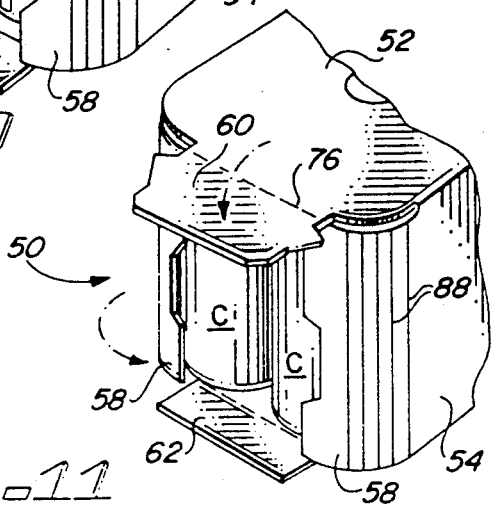
FIG. 11

SLEEVE-TYPE CARRIER

FIELD OF THE INVENTION

This invention relates to article carriers which are adapted to be loaded through the open ends of an interim sleeve configuration. More particularly, it relates to an end panel arrangement which facilitates closing the ends of the carrier and allows the end corner portions of the carrier to follow the contour of the packaged articles.

BACKGROUND OF THE INVENTION

Sleeve-type carriers are typically formed from a blank which is delivered to a packaging machine in the form of a collapsed sleeve. The sleeve is erected or opened in the machine and articles are loaded through one or both ends of the sleeve, after which the ends of the carrier are closed. Formation of the end panels of the carrier normally requires the end panel flaps and the dust flaps to which the end panel flaps are glued to be separately folded into place by separate folding steps. While this process continues to be successfully employed in the packaging industry, there are certain areas which nonetheless could be improved.

It would be desirable to facilitate the closing of the end panels by providing a more automatic closing operation. It would also be desirable to have a carrier which is capable of more closely following the contours of curved packaged articles in order to more tightly hold the articles within the package. Normally, the end panels of a sleeve-type carrier form right angles with the side panels, which makes it difficult for the corner areas of the carrier to contact curved articles such as beverage cans and bottles.

An example of a more automatic end closure arrangement is disclosed in U.S. Pat. No. 4,747,487 which provides triangular webs for connecting the end panel flaps to the dust flaps or so-called closure flaps. The connecting webs cause the dust flaps to move into place when the end panel flap is moved from an open vertical position to its final closed position in the end of the carrier. In addition, separate triangular corner panels are provided between the side panels and the closure flaps. The angles formed by the corner panels with both the side panels and the closure panels are greater than 90°, which enables the corner area of the carrier to conform to a curved surface more readily than the usual right angled corner configuration of conventional sleeve-type carrier designs.

Although the patented carrier is an improvement over conventional designs in the areas discussed, it would be desirable to further improve certain features of the carrier. The connecting webs are not always conducive to easy closure of the end panel flaps due to the thickness of the various folds of material in the end corner areas. Also, the triangular corner panel arrangement does not provide the desired degree of contact with the surface of curved articles. It is therefore an object of the invention to provide a sleeve-type carrier that improves upon the performance of prior art carriers in the areas discussed.

BRIEF SUMMARY OF THE INVENTION

A sleeve-type carrier is provided with an end panel comprised of dust flaps extending transversely from the side panels and an overlying end panel flap. The end panel flap is connected to either the top or bottom panel by a fold line which is shorter than the width of the top or bottom panel, and is further connected on either side to an end portion of the adjacent dust flap by a tab. Each tab is connected to the dust flap and to the end panel flap by fold lines. This arrangement permits the carrier sleeve to be loaded with articles when the end panel flap is in its horizontally open position, followed by automatic closure of the dust flaps when the end panel flap is moved first to an open vertical position, then to its closed position. This arrangement results in the tabs being folded about their fold lines so that they are in face-to-face relationship with the interior face of the end panel flap and with the exterior face of the associated dust flap.

The fold lines of the tabs in the blank from which the carrier is formed are aligned in converging directions, and the tabs define an edge portion of cutouts further defined by edge portions of the end panel flaps, the dust flaps and the associated top or bottom panel section.

In one embodiment of the invention, each dust flap is a continuation of its associated side panel and is curved about the vertically extending cylindrical portions of adjacent articles in the carrier. Means such as score lines may be provided to facilitate the curving movement of the dust flaps into place. In another embodiment each dust flap is connected to its associated side panel along a fold line extending at an angle to the top and bottom panels. This also enables the dust flaps to follow the contour of vertically extending cylindrical portions of adjacent articles.

The carrier of the invention does not utilize the connecting webs of the prior art, thus avoiding problems created by the folding of several thicknesses of blank material in the corner area, and provides a tighter fitting beveled corner area adapted to engage the contours of curved articles in the package.

The above and other aspects and benefits of the invention will readily be apparent from the more detailed description of the preferred embodiments of the invention which follows.

BRIEF DESCRIPTION OF THE DRAWING

FIG. 1 is a pictorial view of one embodiment of the carrier of the invention;

FIG. 3 is a pictorial view of one end of a carrier sleeve in condition to be loaded with articles, with the end panel flap in horizontal position;

FIG. 4 is a pictorial view of one end of the carrier sleeve of FIG. 3, with the end panel flap shown in vertically lowered position and the dust flaps in partially closed position;

FIG. 5 is a pictorial view of one end of the carrier sleeve of FIG. 3, with the end panel flap shown in interim horizontal position as it is being moved into final closed position;

FIG. 6 is a partial side elevation of the carrier of FIG. 1;

FIG. 7 is a pictorial view of another embodiment of the carrier of the invention;

FIG. 9 is a pictorial view of one end of a carrier sleeve of the embodiment of FIG. 7 in condition to be loaded with articles, with the end panel flap in horizontal position;

FIG. 10 is a pictorial view of one end of the carrier sleeve of FIG. 9, with the end panel flap shown in vertically lowered position and the dust flaps in partially closed position;

FIG. 11 is a pictorial view of one end of the carrier sleeve of FIG. 9, with the end panel flap shown in interim horizontal position as it is being moved into final closed position; and FIG. 12 is a partial side elevation of the carrier of FIG. 7.

DETAILED DESCRIPTION OF THE PREFERRED EMBODIMENTS

Figure 2:
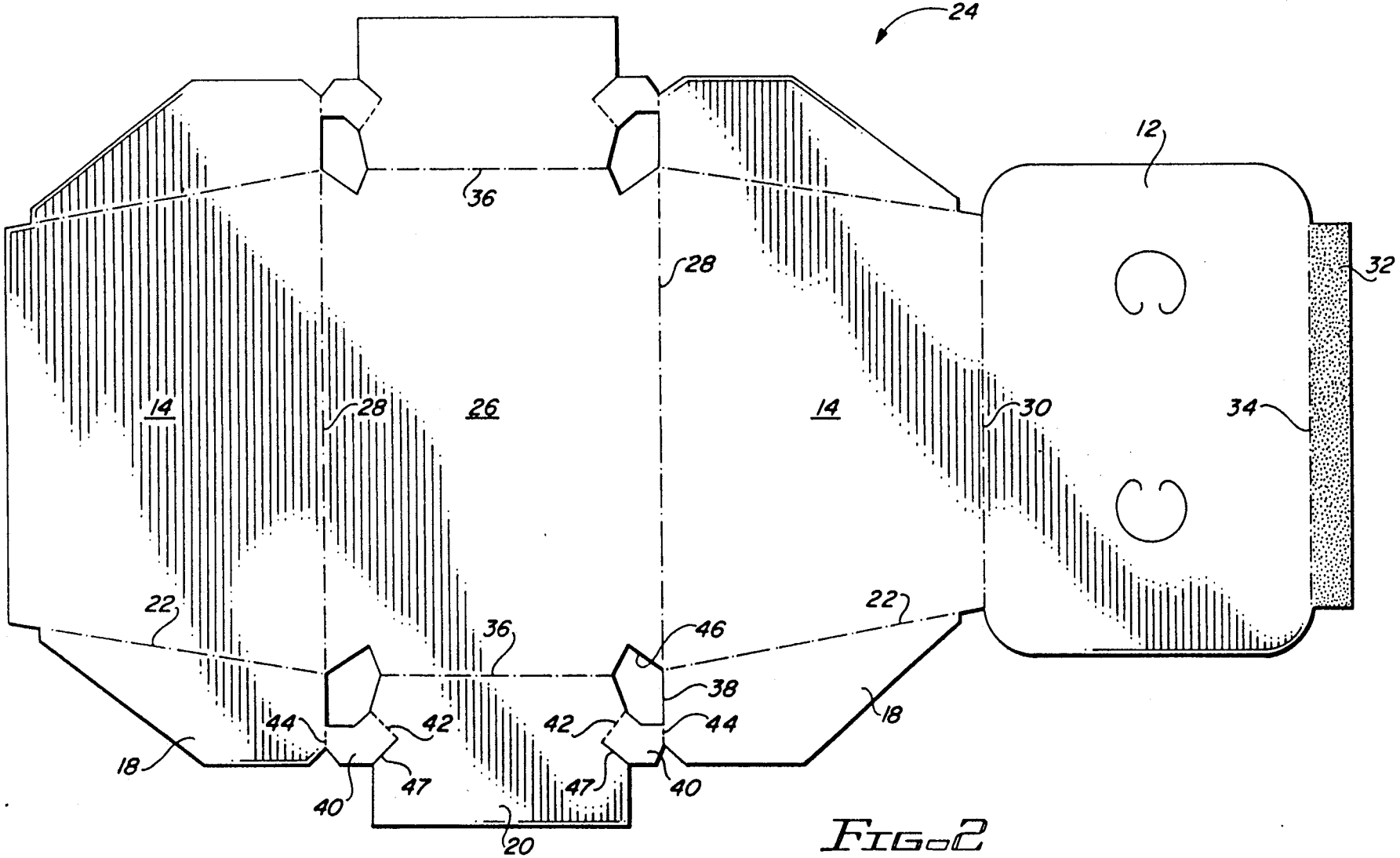
FIG. 2 is a plan view of a blank used to form the carrier of FIG. 1.

Referring to FIG. 1, a carrier 10 embodying the invention includes a top panel 12 connected to side panels 14 and a bottom panel, not visible in this view, also connected to the side panels. Each end panel 16 is comprised of dust flaps 18 extending transversely from the side panels 14 and an end panel flap 20 extending up from the bottom panel to overlie the dust flaps. The dust flaps 18 are connected to the side panels along fold lines 22 which are tapered in a direction away from the ends of the carrier, thus forming an obtuse angle with the top edge of the side panels. The end panel snugly engages the cylindrical contour of adjacent beverage cans C packaged in the carrier in a manner described below.

The carrier is formed from the blank 24 shown in FIG. 2, wherein like reference numerals to those used in FIG. 1 refer to similar elements. The blank is comprised of flexible sheet material of suitable strength, such as paperboard of conventional carrier thickness. A bottom panel section 26 is connected to the side panel sections 14 by fold lines 28, and the top panel section 12 is connected to one of the side panel sections by fold line 30. A glue strip 32 is connected to the other end of the top panel section along fold line 34. The angled relationship of the fold line 22 to the fold line 30, which coincides with the top edge of the interior side panel 14, corresponds to the obtuse angle the fold lines 22 make with the top edge of the carrier. It can be seen that the fold lines 22 form an acute angle with the fold lines 28, representing the lower edge of the side panels, so that the side panels are in the shape of a trapezoid.

The end panel flaps 20 are connected to the end edges of the bottom panel section 26 by fold lines 36 and to the adjacent edges 38 of the dust flaps by a tab 40. The tabs 40 are connected to the side edges of the end panel flaps along fold lines 42 located intermediate the fold line 36 and the end of the end panel flap 20, and to the dust flaps at the end portion of the dust flap edge 38 along fold lines 44. The tab fold lines 44 are substantially aligned with the fold lines 28, while the tab fold lines 42 are angled out so that the fold lines 42, if extended, would form an acute angle with extensions of the fold lines 44. The configurations of the tabs 40, the end panel flaps 20 and the bottom panel 26 are such that cutouts 46 are defined by spaced edge portions of these elements and the edges 38 of the dust flaps 18, an arrangement made possible by the fact that the fold line 36 is shorter than the width of the bottom panel. A corner of the cutout coincides with the intersection of the fold lines 22 and 28. In the illustrated blank design, the tab fold lines 42 are inwardly spaced from the side edges of the end panel flap 20, and so are separated from the end panel flap by slits 47, which form an edge of the tabs. If the fold lines 42 were connected to the side edges of the end panel flaps, the need for slits would of course be obviated.

To form a carrier from the blank, the side panel section 14 at the end of the blank is folded in about fold line 28 and the top panel 12 is folded in about fold line 30 so that adhesive on the glue strip 32, indicated by the stippling, adheres the glue strip to the free edge area of the end panel section 14. This is a conventional procedure in the fabrication of a sleeve-type carrier, resulting in a collapsed sleeve. The sleeve in collapsed form is introduced to a packaging machine where the sleeve is opened in a manner well known in the art by squaring up the collapsed sleeve. The resulting erected sleeve is illustrated in FIG. 3, wherein the end panel flap 20 and the dust flaps 18 are substantially outward extensions of the bottom panel 26 and the side panels 14, respectively. It is while the sleeve is in this condition, with the open ends being unblocked by the flaps 18 or 20, that articles are loaded through one or both of the open ends.

After the articles have been loaded, the end panels are closed by first pivoting the end panel flap 20 down so that it forms substantially a right angle with the bottom panel 26. As shown in FIG. 4, downward movement of the end panel flap 20 causes the tabs 40 to fold up about their fold lines 42, pivoting the dust flaps 18 inwardly about their fold lines 22 to a position somewhat short of their fully closed position. This movement of the dust flaps brings the fold lines 44 of the tabs 40 into substantially horizontal position, so that when the end panel flap 20 is then pivoted back up into its original open position, shown in FIG. 5, the tabs fold up about the fold lines 44. This causes the dust flaps 18 to move to their final closed position at right angles to the side panels. The biases created at the fold lines 42 and 44 by this folding action results in the tabs and dust flaps being essentially locked into place.

The final step in closing the ends of the carriers in order to produce the package of FIG. 1 is to fold the end panel flaps 20 up about the fold lines 36 to adhere the end panel flaps to the dust flaps 18 by adhesive applied to the end panel flaps, as indicated by the stippling in FIG. 5. The adhesive will preferably be applied to the tabs 40 as well, to adhere both the tabs and the end panel flaps directly to the dust flaps. As can be seen from FIG. 5, the tabs lie directly between the end panel flaps and the dust flaps in face-to-face relationship with both.

Referring now to FIG. 6 in addition to FIGS. 1-5, the angled fold lines 22 between the dust flaps and their associated side panels permit the bottom portions of the dust flaps to extend at right angles to the side panels in order to be in contact with the end panel flaps 20 while allowing the upper portions of the dust flaps to flex around the upper contour of the can C. Normally, a rectangular carrier is designed to contact only those portions of curved packaged articles which abut the end panels and side panels. The present arrangement, however, enables the dust panels to contact portions of the curved peripheries of the corner articles to produce a tighter package.

Another embodiment of the invention is illustrated in FIG. 7 wherein the carrier 50 is comprised of a top panel 52 connected to side panels 54 which are also connected to a bottom panel, not visible in this view. The end panel 56 is comprised of dust flaps 58 which are not connected to the side panels by fold lines but are actually continuations or extensions of the side panels 54, curving around substantially the full height of the cans C. End panel flaps 60 and 62 extend transversely from the top and bottom panels, respectively, to overlie the dust flaps.

Figure 8:
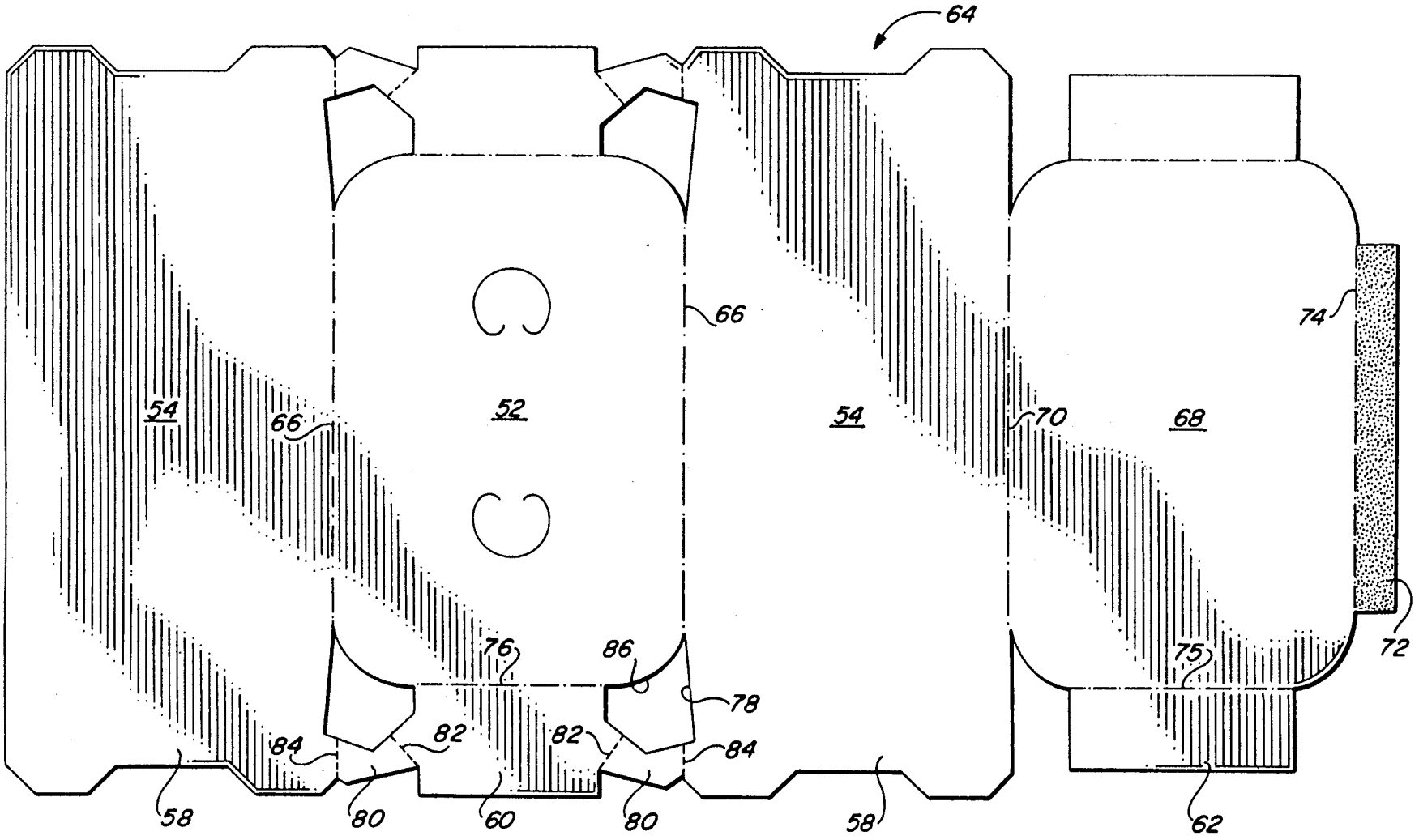
FIG. 8 is a plan view of a blank used to form the carrier of FIG. 7.

The carrier 50 is formed from the blank 64 of FIG. 8, wherein like reference numerals to those used in FIG. 7 denote like elements. Top panel section 52 is connected to the side panel sections 54 by fold lines 66, while a bottom panel section 68 of similar size and shape as the top panel section is connected to one of the side panel sections by fold line 70. Glue strip 72 is connected to the other end of the bottom panel section 68 along fold line 74. The end panel flaps 62 are connected to the bottom panel by fold lines 75, while the end panel flaps 60 are connected to the end edges of the top panel section 52 by fold lines 76 and to the adjacent edges 78 of the dust flap portions 58 of the side panels by tabs 80. The tabs 80 are connected to the side edges of the end panel flaps intermediate the fold line 76 and the end of the end panel flap 60 by fold lines 82, and to the dust flap portions at the end of the edge 78 by fold lines 84. The tab fold lines 84 are substantially aligned with the fold lines 66 and, as in the previous embodiment, the tab fold lines 82 are angled out so that the fold lines 82, if extended, would form an acute angle with extensions of the fold lines 84. The fact that the fold line 76 is shorter than the width of the top panel 52 enables the tabs 80, the end panel flaps 60 and the top panel 52 to be configured such that cutouts 86 are defined by spaced edge portions of these elements and the edges 78 of the dust flap portions 58. A corner of the cutout coincides with the end of the fold line 66.

A carrier is formed from the blank in a manner similar to the method described in connection with the first embodiment. The end side panel section 54 is folded in about fold line 66 and the bottom panel 68 is folded in about fold line 70 so that adhesive on the glue strip 72, indicated by the stippling, adheres the glue strip to the free edge area of the end panel section 54. When the resulting collapsed sleeve is squared up it appears as in FIG. 9. The end panel flaps 60 and 62 are substantially outward extensions of the top and bottom panels 52 and 68, and the dust flap extensions of the side panels 54 lie in the same plane as the side panels. As explained in connection with the previous embodiment, the articles to be packaged are loaded through one or both of the open ends of the carrier sleeve.

After the articles have been loaded, the end panels are closed by first pivoting the end panel flap 60 up, as shown in FIG. 10, so that it forms substantially a right angle with the top panel 52. This causes the tabs 80 to fold down about their fold lines 82, drawing the dust flap extensions 58 toward each other around the peripheries of the corner cans C to a position somewhat short of their fully closed position. Movement of the dust flap extensions in this manner moves the fold lines 84 of the tabs 80 into substantially horizontal position, so that when the end panel flap 60 is then pivoted down to its original open position, shown in FIG. 11, the tabs fold down about the fold lines 84. Although the tabs are not fully shown in FIG. 11 due to being hidden by the end panel flap 60, the folding sequence is similar to the folding of the tabs in FIG. 5 of the first embodiment, except that the end panel flaps to which the tabs are connected are joined to the top panel instead of to the bottom panel. The dust flap extensions 58 are thereby moved to their final closed position, whereby the end portions are at right angles to the side panels. The drawing or curving of the dust flap extensions around the corner articles may be facilitated, if desired, as for example by providing spaced vertical score lines 88 in the corner -areas of the dust flap extensions.

The ends of the carrier are closed by pivoting the end panel flaps 60 and 62 about their fold lines toward each other after adhesive has been applied. As in the first embodiment, the tabs 80 lie directly between the end panel flaps and the dust flap extensions in face-to-face relationship with both. The closed dust flap extensions are further illustrated in FIG. 12, which also more clearly shows the gaps 90 that exist between the top and bottom edges of the dust flap extensions and the adjacent top and bottom panels. This spacing prevents the dust flap extensions from dragging against the top and bottom panels as they are drawn around the corner articles in the carrier package. The spacing is a result of the edges 78 of the dust flap extensions being slightly angled away from the fold line 66 connecting the top panel and the side panels, which is best illustrated in FIG. 8.

It will now be appreciated that both embodiments of the invention provide for automatic closing of the dust flaps as a result of pivoting movement of the end panel flaps, which is made possible by the tabs that connect the end panel flaps to the dust flaps, and for engagement of the dust flaps with the curved surfaces of articles located in the corners of the carrier. The tabs have been shown as being connected to the end portions of the dust flaps, which results in the ends of the dust flaps being spaced from each other. This is a preferred arrangement since wider dust flaps are not needed due to the presence of the end panel flap across the space between the dust flaps, resulting in a reduction of blank size and a corresponding reduction in cost. This arrangement also lessens the likelihood of interference with the movement of the dust flaps during formation of the end panels. If desired, the dust flaps could be widened so as to be more closely spaced, in which case the tabs would be connected at a point intermediate the width of the dust flaps.

Although the end panel flap of the first embodiment of the invention has been described as being connected to the bottom panel, it could, if desired, be connected to the top panel instead. The disclosed arrangement is preferred, however, because it allows the bottom panel to be longer than the top panel, which is necessary if the articles being packaged are wider at the bottom than the top, as in the case of conventional beverage cans and bottles.

The end panel flap associated with the tabs is connected to the top panel in the second embodiment of the invention because this also facilitates loading due to the fact that the dust flap extensions tend to be spaced a greater distance apart at the edge opposite the edge connected to a tab. Although this is the preferred arrangement, the tabs could, if desired, be associated with the bottom end panel flap instead.

Although the dust flaps of the second embodiment are not connected to the side panels by fold lines and are actually extensions of the side panels, they are referred to in the claims as dust flaps since they perform the function of dust flaps in addition to providing snug engagement to the corner articles in the carrier.

It should now be apparent that the invention is not necessarily limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A sleeve-type carrier for packaging a plurality of articles, comprising:

top and bottom panels connected to side panels along fold lines to form a sleeve configuration;

an end panel at each end of the sleeve;

each end panel being comprised of dust flaps extending transversely from the side panels and an end panel flap, the dust flaps having upper and lower edges and a free end connecting the upper and lower edges, the end panel flap being connected by a fold line to either the top or bottom panel, the end panel flap fold line having a length less than the width of the associated top or bottom panel;

the end panel flap overlying the dust flaps and being adhered thereto; and the end panel flap being connected on either side thereof to a first portion of either the upper or lower edge of the adjacent dust flap by a tab, said first edge portion being spaced from the associated side panel by a second portion of said upper or lower edge, said second edge portion comprising an edge of a cutout extending between said dust flap and the end panel flap, the tab being connected to said upper or lower first edge portion by a first tab fold line and to the end panel flap by a second tab fold line, said first tab fold line being substantially parallel to the top and bottom panels and said second fold line extending at an angle thereto.

2. A sleeve-type carrier according to claim 1, wherein the tabs are located between the end flap and the adjacent dust flap, each tab being folded about its second tab fold line so as to be in face-to-face relationship with the interior face of the end panel flap, and about its first fold line so as to be in face-to-face relationship with the exterior face of the associated dust flap.

3. A sleeve-type carrier according to claim 1, wherein each dust flap is a continuation of the associated side panel, the dust flaps following the configuration of adjacent portions of cylindrical articles in the carrier.

4. A sleeve-type carrier according to claim 3, wherein the dust flaps include score lines extending at right angles to the top and bottom panels to facilitate the curving thereof about the cylindrical portions of adjacent articles.

5. A sleeve-type carrier according to claim 3, wherein the free ends of the dust flaps at each end of the carrier are spaced from each other.

6. A sleeve-type carrier according to claim 3, including a second end panel flap connected by a fold line to the top or bottom panel opposite the top or bottom panel to which the first-mentioned end panel flap is connected, the second end panel flap overlying the associated dust flaps and being adhered thereto.

7. A sleeve-type carrier according to claim 6, wherein the first-mentioned end panel flap is connected to the top panel and the second end panel flap is connected to the bottom panel.

8. A sleeve-type carrier according to claim 1, wherein each dust flap is connected to the associated side panel along a fold line extending at an angle to the top and bottom panels to enable the dust flaps to follow the contour of adjacent articles having cylindrical portions extending at right angles to the top and bottom panels.

9. A sleeve-type carrier according to claim 8, wherein the end panel flap is connected to the bottom panel and the dust flap fold lines extend from a point adjacent the end of the bottom panel to a point offset from the end of the top panel.

10. A blank for forming a sleeve-type carrier for packaging a plurality of articles, comprising:

a first top or bottom panel section connected by fold lines to side panel sections on either side thereof and a second top or bottom panel section connected by a fold line to one of the side panels, the top, bottom and side panel sections being adapted to be folded along the fold lines to form a sleeve configuration;

an end panel flap connected to each end of the first top or bottom panel section by a fold line having a length less than the width of the associated top or bottom panel;

dust flaps extending from each end of the side panel sections and terminating in free ends, the dust flaps having edges spaced from the end panel flaps;

each end panel flap being connected on either side thereof to a first portion of the spaced edge of an adjacent dust flap by a tab, said first edge portion being spaced from the associated side panel section by a second portion of said upper or lower edge, said second edge portion comprising an edge of a cutout extending between said dust flap and the end panel flap, the tab being connected to said first spaced edge portion by a first tab fold line and to the end panel flap by a second tab fold line, said first tab fold line being substantially parallel to the fold lines connecting the side panels to the top and bottom panels and said second fold line extending at an angle thereto;

the end panel flaps being adapted to overlie the dust flaps of a carrier formed from the blank.

11. A blank for forming a sleeve-type carrier according to claim 10, wherein each tab is folded about its second tab fold line so as to be in face-to-face relationship with the interior face of the end panel flap in a carrier formed from the blank, and about its first fold line so as to be in face-to-face relationship with the exterior face of the associated dust flap in such a carrier.

12. A blank for forming a sleeve-type carrier according to claim 10, wherein each dust flap is a continuation of the associated side panel section, the dust flaps being adapted to follow the contour of cylindrical portions of articles extending at right angles to the top and bottom panels of a carrier formed from the blank.

13. A blank for forming a sleeve-type carrier according to claim 12, including a second end panel flap connected by a fold line to each end of the second top or bottom panel section, the second end panel flap being adapted to overlie the associated dust flaps of a carrier formed from the blank.

14. A blank for a sleeve-type carrier according to claim 10, wherein each dust flap is connected to the associated side panel section along a fold line extending at an acute angle to the fold line connecting the side panel section to the first top or bottom panel section, the dust flaps thereby being capable of following the contour of adjacent articles having cylindrical portions extending at right angles to the top and bottom panels of a carrier formed from the blank.

15. A blank for a sleeve-type carrier according to claim 14, wherein the dust flap fold lines extend from a point adjacent the end of the first top or bottom panel section to a point offset from the end of the second top or bottom panel section.

* * * * *